United States Patent [19]

Flensburg et al.

[11] Patent Number: 4,576,369

[45] Date of Patent: Mar. 18, 1986

[54] METHOD IN PRODUCING STITCHED PRINTED MATTERS AND FEEDER FOR WORKING THE METHOD

[76] Inventors: Carl G. A. Flensburg, Per Albin Hanssons väg 52B, S-214 63 Malmö; Rolf H. V. Isaksson, Diakongatan 59, S-216 23 Malmö, both of Sweden

[21] Appl. No.: 517,993

[22] Filed: Jul. 29, 1983

Related U.S. Application Data

[63] Continuation of Ser. No. 386,515, Jun. 9, 1982, abandoned.

[51] Int. Cl.[4] ..... B65H 39/02

[52] U.S. Cl. ..... 270/54; 198/644

[58] Field of Search ..... 270/53-54, 270/58; 198/644

[56] References Cited

U.S. PATENT DOCUMENTS 765,911 7/1904 Balze ..... 270/53

3,366,225 1/1968 Thorp ..... 270/54 X 3,966,185 6/1976 McCain ..... 270/54 X 4,076,232 9/1978 Kistner ..... 270/54

*Primary Examiner*—A. J. Heinz

*Attorney, Agent, or Firm*—Lerner, David, Littenberg, Krumholz & Mentlik

[57] ABSTRACT

Method in producing stapled printed matters. Signatures are laid astride one upon the other on a conveyor path (10) in a number of stations (12, 29, 34) distributed along the conveyor path. The signatures are transferred along the conveyor path at a rate which is brought to vary cyclically between a lower value while signatures are being received, and a higher value while signatures are being transferred between the stations.

The signatures laid one upon the other are stapled and trimmed by operative movements allowing the signatures to be transferred continuously along the conveyor path while being stapled and trimmed.

7 Claims, 8 Drawing Figures

METHOD IN PRODUCING STITCHED PRINTED MATTERS AND FEEDER FOR WORKING THE METHOD

This is a continuation of application Ser. No. 386,515 filed 6/9/82 and now abandoned.

The present invention relates to a method in producing stitched printed matters wherein signatures are laid astride one upon the other on a conveyor path in a number of stations arranged along the conveyor path, and the signatures laid one upon the other are stitched and are trimmed along the three free edges.

In producing magazines and similar printed matters by applying the present technique as far as laying, stitching and trimming of the signatures are concerned, these operations form a bottle-neck in the production procedure because it is not possible as far as these functions are concerned to operate at the high production rate allowed by modern printing machines if the present technique is applied. The development of the apparatus required for said functions, in other words has not kept pace with the development of the printing machines.

The purpose of the invention is to make possible an increase of the production rate from the present rate of 13,000 copies per hour to about 20,000 copies per hour, and for this purpose the method according to the invention has obtained the characteristics according to claim 1.

For working the method according to the invention there is also provided a feeder for laying the signatures astride one upon the other on the conveyor path. This feeder comprises in a known manner a compartment for the signatures and a rotatable member for gripping the signatures in the compartment one at a time and withdrawing the gripped signature to be engaged subsequently at the back with a fixed abutment, and two rotatable members for gripping one and the other, respectively, of the two halves, folded against each other, of the signature engaged with the abutment while the signature being pulled downwards to straddle the conveyor path. In present embodiments of such a feeder the last-mentioned two rotatable members are arranged radially outside the first-mentioned member with the rotational axis extending in parallel to the rotational axes of the first-mentioned member. In that case each of the rotatable members is provided with one gripper only, and the number of grippers on the rotatable members can be increased only by giving these members and thus the entire feeder larger dimensions, the feeder being cumbersome and requiring large space as a consequence thereof. So far no feeder with more than one gripper on the rotatable members has been proposed, and an upper limit for the capacity of the feeder is set thereby because the rotational speed of the members cannot be increased beyond a predetermined value without jeopardizing the operative reliability.

In the feeder of the kind referred to above, proposed according to the invention, the capacity has been increased by the feeder having obtained the characteristics according to claim 4.

Figure 1:
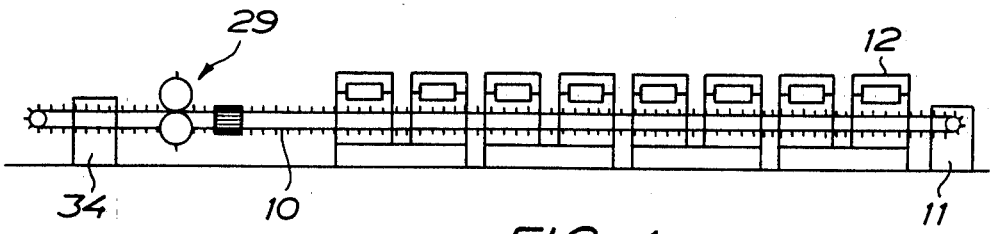
Figure 2:
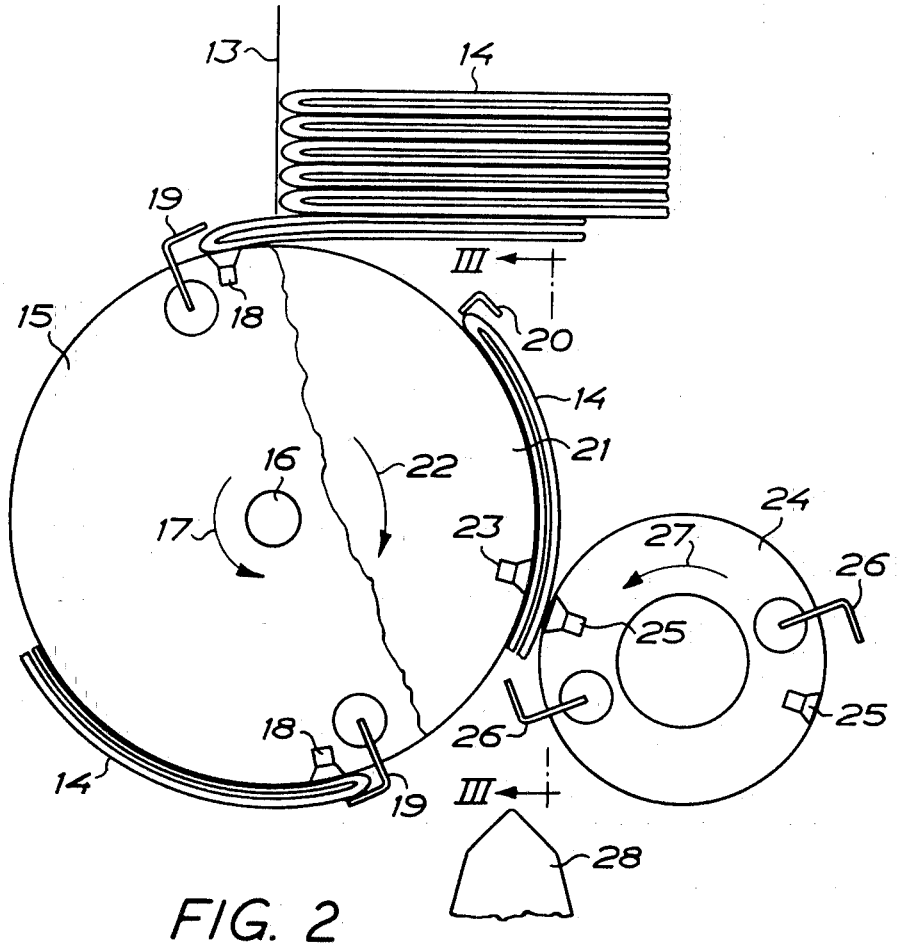
Figure 3:
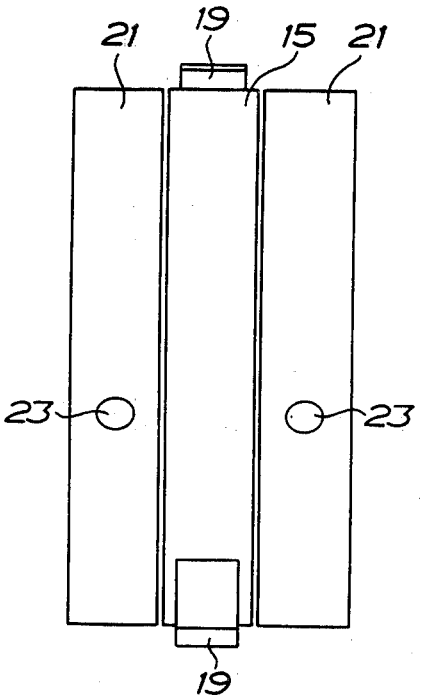
Figure 4:
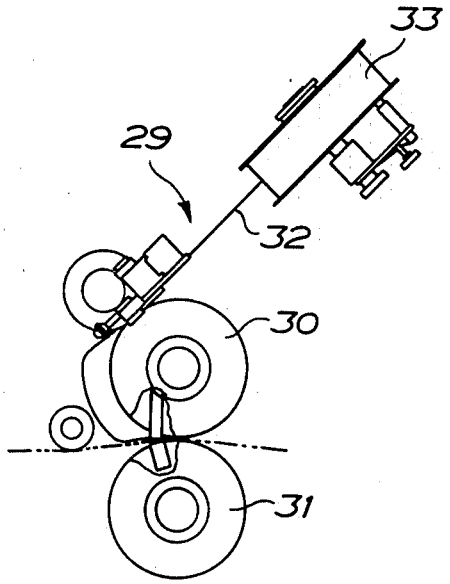
Figure 5:
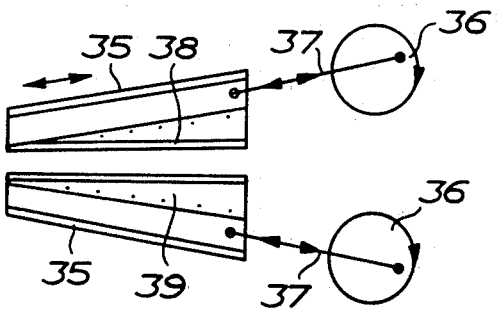
Figure 6:
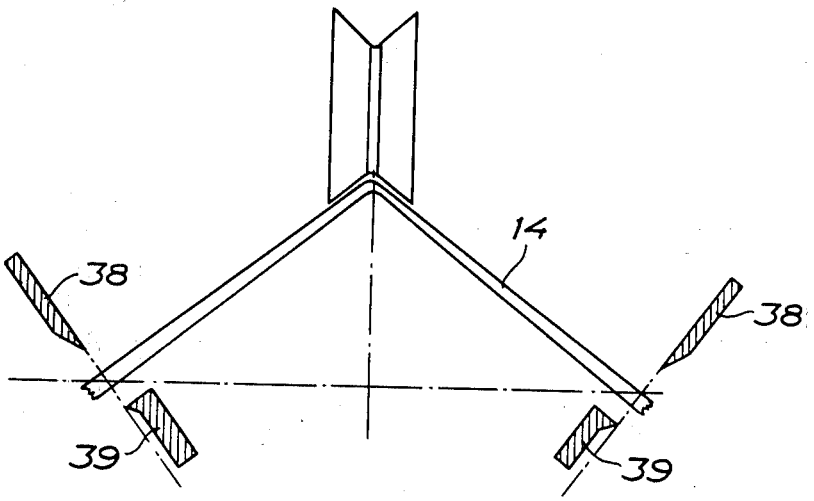
Figure 7:
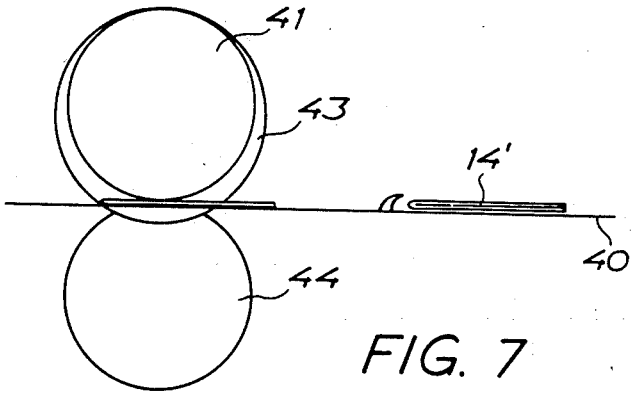
Figure 8:
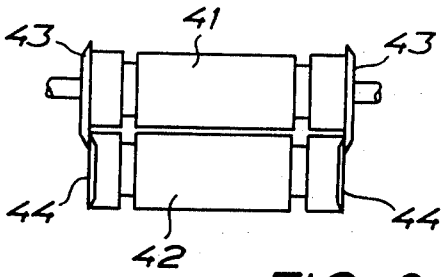

In order to illustrate the invention this will be described in more detail below, reference being made to the accompanying drawings, in which FIG. 1 is a diagrammatic side view of an apparatus for working the method according to the invention, FIG. 2 is a diagrammatic side view of the functional elements in a feeder, FIG. 3 is a view along line III—III in FIG. 2, FIG. 4 is a side view of a roller-type stapler, FIGS. 5 and 6 are a side view and a cross-sectional view, respectively, of a cutter with reciprocating knives, and FIGS. 7 and 8 are a side view and an end view, respectively, of a cutter with roller-type knives.

The apparatus in FIG. 1 comprises a conveyor path 10 which can include in a known manner a saddle-formed support for straddling signatures, and an endless chain which can be moved along this support. The chain is driven by drive means 11 of the Jefferson-type such that the chain is driven at a speed varying cyclically between a lower value and a higher value. A number of feeders 12 are arranged along the conveyor path and in the present case these feeders are of the construction disclosed in FIGS. 2 and 3.

Each feeder 12 comprises a compartment 13 for signatures 14, i.e. folded printed sheets, which are laid one upon the other with the back in one and the same direction. A cylinder 15 is mounted to be driven counter-clockwise from a shaft 16 over an epicyclic gear as indicated by an arrow 17, and two diametrically opposite vacuum-type grippers 18 are mounted on this cylinder, each vacuum-type gripper being combined with a mechanical gripper 19. These grippers and means for controlling the operation thereof can be of conventional type. The grippers 18, 19 on the cylinder 15 are controlled in such a manner that the grippers during the rotation of the cylinder 15 grip the signatures 14 in the compartment 13 one at a time at the back and withdraw the signature gripped from the compartment and transfer the signature for engagement with a fixed abutment 20. These steps are illustrated in FIG. 2.

For the continued handling of the signatures as they are engaged with the abutment 20 two cylinders 21 are mounted one at each side of the cylinder 15 coaxially therewith. They are also arranged to be driven from the shaft 16 over an epicyclic gear but clockwise as has been indicated by an arrow 22, and they are provided with two diametrically opposite vacuum-type grippers 23. Radially outside the shaft 16 a cylinder 24 is mounted which has also two diametrically opposite vacuum-type grippers 25, and mechanical grippers 26 are associated with these vacuum-type grippers. The cylinder 24 is driven counter-clockwise according to the arrow 27. All cylinders are synchronized with each other as to the rotation such that the grippers of the cylinders 21 and 24 grip the signature engaged with the abutment 20, from opposite sides and pull the signature downwards while separating the two halves of the signature, folded against each other, such that the signature will be located astride the saddle in the conveyor path mentioned above. This saddle is partly shown in FIG. 2 at 28. Along the saddle, nozzles may be arranged for blowing pressurized air such that there is provided on top of the saddle an air cushion which attenuates the movement of the signatures to prevent the signature from bouncing back; on the contrary the signatures land smoothly on the saddle and the conveyor chain located thereon.

Also advancement of the conveyor chain by means of the drive means 11 of Jefferson-type is synchronized with the operation of the feeder 12 in such a way that the conveyor chain has the lower speed when receiving signatures, and the higher speed when transporting the signatures between the feeders. In this manner the signatures laid on the conveyor chain, and then—as the conveyor chain passes through the feeders 12 arranged along the chain—the signatures laid one upon the other will be gently carried along in the movement of the conveyor chain without the risk of "slipping" thereof in relation to the conveyor chain or between the signatures.

By two signatures being laid-on for each revolution of the cylinders 15, 21, and 24, the laying-on will be more smooth and safe and, moreover, it can take place at less operational disturbances thanks to the fact that the cylinders 21 are mounted coaxially with the cylinder 15 and not radially outside said latter cylinder as in case of feeders of the present embodiments.

The collected signatures shall now be stapled together, and according to the invention they are stapled by means of a roller-type stapler 29 which is disclosed in more detail in FIG. 4. This device comprises two roller jaws 30 and 31 operating at opposite sides of the back, metal wire 32 being supplied to the upper roller jaw 30 from a supply roll 33 for forming the staples thereof. The roller-type stapler per se forms no part of the present invention. It is used in the method according to the invention because it provides, at a high production rate, a safer and more accurate stapling due to the fact that the stapling moment proper is considerably shorter than when the conventional stapling with a reciprocating movement is used.

It is common that the stapled signatures are trimmed to exact format in a three-edge cutter or so-called trimmer which reciprocates vertically and transversely of the moving direction of the conveyor chain and trims the laid-on and stapled signatures, i.e. the magazine produced, simultaneously at three edges. The reciprocating movement is incompatible with the high production rate aimed at by applying the method according to the invention, and therefore the trimming of the magazines in applying the method according to the invention is performed in two steps by means of rotating or elliptically moving cutting edges.

In a first station 34 the edge of the magazine, extending in parallel to the back, is trimmed and in this case a cutter with elliptically movable cutting edges can be used, e.g. of the embodiment disclosed and described in Swedish Pat. No. 194,227. If the magazine straddles a saddle which is relatively wide, the sheets can be trimmed by two cuts, viz. one cut for each half of the magazine; accordingly two cutters have to be arranged one at each side of the conveyor path. However, it is also possible to trim the magazine by one cut if the saddle is made narrower so that the magazine can be compressed completely at the edge opposite to the back, when being trimmed. In the latter case one cutter only is arranged below the conveyor path and operates with knives which are movable substantially horizontally.

However, for trimming the edge of the magazine, which extends in parallel to the back, also a cutter of the construction shown in FIGS. 5 and 6 can be used. Two knife bars 35 are guided in stationarily mounted guides to be moved towards and away from each other by a reciprocating movement in the longitudinal direction of the knife bars. Each knife bar is connected to a crank or eccentric 36 by means of a crank rod 37 for generating this reciprocating movement of the knife rods in synchronism. The upper knife rod supports a cutting knife 38, and the lower knife rod supports a cutting knife 39. By the knives being moved at the same rate as the magazines advanced on the conveyor path in the longitudinal direction thereof at the same time as the knives being moved together for trimming the edges of the magazines straddling the saddle, a flying trimming of said edges is performed. FIG. 6 discloses the trimming of a magazine by two cuts but it is also possible to trim by one cut, the knives operating horizontally in that case.

For trimming the two remaining edges of the magazine, viz. those which extend perpendicularly to the back, the magazines are laid horizontally on a conveyor 40, FIG. 5, where the magazines are indicated at 14', and this can be done in a known manner and by known means and, therefore, the transfer from the conveyor path 10 to the conveyor 40 has not been shown in detail here. The trimming of the edges extending perpendicularly to the back can be made by using the cutter shown in FIGS. 5 and 6, one cutter of this type being arranged at each side of the conveyor, operating vertically. Alternatively, a cutter of the type shown in FIGS. 7 and 8 can be used, which comprises an upper roller 41 and a lower roller 42 between which the magazines are brought to pass. The upper roller 41 is provided with eccentric roller knives 43 while the lower roller 42 forms a counter-knife 44 for the roller knives. Finally, also for this trimming elliptically movable cutting edges can be used arranged at opposite sides of the conveyor 40.

Thanks to the use of cutters having rotating or elliptically movable cutting edges the apparatus space is reduced and at the same time the rate of the cutting can be increased. However, cutters having such cutting edges additionally generate considerably less noise than the common three-edge cutter having a reciprocating movement.

In the foregoing, the means used for working the method according to the invention have not been described more closely as far as the constructive details are concerned, since these details can be easily proposed and constructed by the man skilled in the art by applying the technique known in the art. The basic embodiment of the apparatus used can be modified within the scope of the accompanying claims, and as an example of such a modificaton it should be mentioned that the feeder can have more than two grippers or pair of grippers on each of the rotatable cylinders 15, 21, and 24.

We claim:

1. A method for producing stitched printed matters comprising the steps of laying signatures on a saddle at a plurality of spaced apart stations arranged along a conveyor path, advancing said signatures along said conveyor path between and through said stations wherein at least some of said signatures are being laid one upon the other as said signatures are advanced through said stations, cyclically increasing and decreasing the speed of said advancing of said signatures along said conveyor path between a first lower speed and a second higher speed, said signatures being advanced through said stations at said first lower speed and between said stations at said second higher speed, and stapling and trimming said signatures laid one upon the other as said signatures are continuously advanced along said conveyor path.

2. The method of claim 1, wherein said signatures include a back and adjacent upper and lower sides.

3. The method of claim 2 wherein said stapling includes rolling a pair of roller jaws against the upper and lower sides of the back of said signatures laid one upon the other on said saddle and supplying wire to one of said roller jaws from a supply thereof for forming staples therefrom.

4. The method of claim 1 wherein said trimming includes cutting the edges of said signatures by rotating cutting edges provided on an upper roller arranged overlying a lower roller and passing said signatures between said upper and lower rollers.

5. The method of claim 4 wherein said rotating of said cutting edges include elliptically moving said cutting edges.

6. An apparatus for producing stitched printed matters, said apparatus comprising a saddle conveyor for advancing signatures having a back there along, means for cyclically increasing and decreasing the speed of said conveyor between a first lower speed and a second higher speed, and a plurality of signature feeders arranged along said conveyor for laying signatures thereon, said signatures being advanced past said feeders at said first lower speed and between said feeders at said second higher speed, each of said feeders including a magazine for storage of said signatures, rotative gripping means for gripping one at a time said signatures in said magazine at the back thereof and for withdrawing said signatures therefrom, a fixed abutment for engagement with the withdrawn signatures, and a pair of rotative gripping members, one of said rotative gripping members arranged coaxial with said rotative gripping means and located adjacent one side thereof and the other of said rotative gripping members positioned radially outside said rotative gripping means, said rotative gripping members gripping opposite sides of said signatures in engagement with said fixed abutment for separating said signatures while laying said signatures astride said conveyor.

7. The apparatus of claim 6 further including a third rotative gripping member arranged coaxial with said rotative gripping means and arranged adjacent the other side thereof.

* * * * *

UNITED STATES PATENT AND TRADEMARK OFFICE

CERTIFICATE OF CORRECTION

PATENT NO. : 4,576,369

DATED : March 18, 1986

INVENTOR(S) : Flensburg, et al

It is certified that error appears in the above-identified patent and that said Letters Patent is hereby corrected as shown below:

In the title page, in the related U.S. application data, add

--which is a continuation of Serial No. 253,842, April 10, 1981, abandoned--

After the related U.S. application data, add

--Foreign application priority data
August 15, 1979 SE Sweden 7906815-1
August 14, 1980 WO PCT International Application PCT/SE80/00208--.

Signed and Sealed this

Seventh Day of February, 1989

*Attest:*

DONALD J. QUIGG

*Attesting Officer*

*Commissioner of Patents and Trademarks*